US009986332B2

(12) United States Patent
Katagiri

(10) Patent No.: US 9,986,332 B2
(45) Date of Patent: May 29, 2018

(54) SOUND PICK-UP APPARATUS AND METHOD

(71) Applicant: Oki Electric Industry Co., Ltd., Tokyo (JP)

(72) Inventor: Kazuhiro Katagiri, Tokyo (JP)

(73) Assignee: OKI ELECTRIC INDUSTRY CO., LTD., Tokyo (JP)

( * ) Notice: Subject to any disclaimer, the term of this patent is extended or adjusted under 35 U.S.C. 154(b) by 0 days. days.

(21) Appl. No.: 15/376,747

(22) Filed: Dec. 13, 2016

(65) Prior Publication Data

US 2017/0289677 A1 Oct. 5, 2017

(30) Foreign Application Priority Data

Mar. 29, 2016 (JP) ..... 2016-065817

(51) Int. Cl.
*H04R 1/02* (2006.01)
*H04R 3/00* (2006.01)
*H04R 1/32* (2006.01)

(52) U.S. Cl.
CPC ..... *H04R 3/005* (2013.01); *H04R 1/326* (2013.01); *H04R 2410/01* (2013.01); *H04R 2430/01* (2013.01); *H04R 2430/21* (2013.01)

(58) Field of Classification Search
CPC ..... G10K 11/1788; G10K 2210/129; G10K 2210/3025; G10K 2210/3211;
(Continued)

(56) References Cited

U.S. PATENT DOCUMENTS

2005/0152563 A1 7/2005 Amada et al.
2013/0287225 A1* 10/2013 Niwa ..... G10L 21/0232 381/92

(Continued)

FOREIGN PATENT DOCUMENTS

JP 2005-195955 A 7/2005
JP 2014-072708 A 4/2014

OTHER PUBLICATIONS

Futoshi Asano, "4.1 General Form of Beamformer: Sound technology series 16: Array signal processing for acoustics: localization, tracking and separation of sound sources", The Acoustical Society of Japan Edition, pp. 70-79, Feb. 25, 2011.

*Primary Examiner* — Vivian Chin
*Assistant Examiner* — Friedrich W Fahnert
(74) *Attorney, Agent, or Firm* — Rabin & Berdo, P.C.

(57) ABSTRACT

To improve, when area sound pick-up is performed to collect sounds from a sound source in a target area, the sound quality of the collected sounds. The present invention relates to a sound pick-up apparatus that performs area sound pick-up. The sound pick-up apparatus calculates a sound volume level of a mixing signal to mix with a target area sound on the basis of power of estimated noise obtained by estimating background noise included in an input signal input from a microphone array, and power of a non-target area sound, adjusts a sound volume level of the input signal, and a sound volume level of the estimated noise to mix with the mixing signal on the basis of the sound volume level of the calculated mixing signal, and generates and outputs a mixed target area sound with which the input signal that is adjusted to have the calculated sound volume level and the estimated noise that is adjusted to have the calculated sound volume level are mixed.

4 Claims, 9 Drawing Sheets

(58) Field of Classification Search
CPC ..... H04R 1/326; H04R 2410/01; H04R 2430/01; H04R 2430/21; H04R 3/005
USPC ..... 381/71.7, 71.11, 92, 94.1, 94.3, 94.7, 381/119, 122
See application file for complete search history.

(56) References Cited

U.S. PATENT DOCUMENTS

2015/0063590 A1* 3/2015 Katagiri ..... H04R 1/406 381/92
2015/0319528 A1* 11/2015 Gao ..... H04R 3/005 381/71.7

* cited by examiner

SOUND PICK-UP APPARATUS AND METHOD

CROSS REFERENCE TO RELATED APPLICATION(S)

This application is based upon and claims benefit of priority from Japanese Patent Application No. 2016-065817, filed on Mar. 29, 2016, the entire contents of which are incorporated herein by reference.

BACKGROUND

The present invention relates to a sound pick-up apparatus and method, that are applicable, for example, when sounds in a specific area are emphasized and sounds in the other areas are reduced.

As technology that collects and separates only sounds in a specific direction in an environment in which a plurality of sound sources are present, there is a beam former (which will be referred to as "BF") using microphone arrays. The BF is technology that forms directionality by using the time difference in signals arriving at the respective microphones (see Futoshi Asano (Author), "Sound technology series 16: Array signal processing for acoustics: localization, tracking and separation of sound sources," The Acoustical Society of Japan Edition, Corona publishing Co. Ltd, publication date: Feb. 25, 2011). The BF roughly comes in two types: an addition-type and a subtraction-type. In particular, a subtraction-type BF can advantageously form directionality with a smaller number of microphones as compared to an addition-type BF. FIG. 6 is a block diagram illustrating the configuration of a sound pick-up apparatus PS to which the conventional subtraction-type BF including two microphones is applied. The sound pick-up apparatus PS to which the conventional subtraction-type BF is applied first uses a delayer to calculate the signal time difference in sounds in a target direction (which will be referred to as "target sounds") which arrive at microphones M1 and M2, and then obtains the target sounds in phase by adding delay.

The sound pick-up apparatus PS calculates the time difference on the basis of the following expression (1). In the expression (1), d represents the distance between the microphones, c represents the speed of sound, and $\tau_L$ represents the delay amount. Further, in the expression (1), $\theta_L$ represents the angle from the vertical direction to the target direction with respect to the straight line connecting the microphones.

$$\tau_L=(d \sin \theta_L)/c \tag{1}$$

Here, if there is a dead angle in the direction of the microphone M1 with respect to the center of the microphones M1 and M2, the sound pick-up apparatus PS performs delay processing on an input signal $\chi_1(t)$ of the microphone M1. Afterwards, the sound pick-up apparatus PS uses a subtractor to perform signal processing in accordance with an expression (2).

$$m(t)=x_2(t)-x_1(t-\tau_L) \tag{2}$$

The sound pick-up apparatus PS can similarly perform subtraction processing in the frequency domain. In that case, the expression (2) is changed into the following expression (3).

$$M(\omega)=X_2(\omega)-e^{-j\omega\tau_L}X_1(\omega) \tag{3}$$

If $\theta_L=\pm\pi/2$, the sound pick-up apparatus PS forms cardioid unidirectionality as illustrated in FIG. 7A. Meanwhile, if $\theta_L=0$ or $\pi$, the sound pick-up apparatus PS forms 8-shaped bidirectionality as illustrated in FIG. 7B. A filter that forms unidirectionality from input signals will be referred to as "unidirectional filter," and a filter that forms bidirectionality will be referred to as "bidirectional filter."

The sound pick-up apparatus PS can form directionality that is strong in a dead angle of bidirectionality by using a spectral subtraction (which will be referred to as "SS"). The directionality of the sound pick-up apparatus PS using SS is formed in all the frequency bands or a specified frequency band in accordance with an expression (4). The expression (4) uses an input signal $X_1$ of the microphone M1, but it is also possible to attain the similar advantageous effects by using an input signal $X_2$ of the microphone M2. In the expression (4), $\beta$ represents a coefficient for adjusting the strength of SS. If SS processing (subtraction processing) yields a negative value, the sound pick-up apparatus PS performs flooring processing of replacing the negative value with 0 or a value obtained by reducing the original value. If the SS processing is used, the sound pick-up apparatus PS can emphasize target sounds by extracting sounds in a direction other than a target direction (which will be referred to as "non-target sounds") with the bidirectional filter, and subtracting the amplitude spectrum of the extracted non-target sounds from the amplitude spectrum of the input signals.

$$Y(n)=X_1(n)-\Sigma M(n) \tag{4}$$

If the conventional sound pick-up apparatus PS uses the subtraction-type BF alone to collect only sounds in a specific area (which will be referred to as "target area sounds"), the conventional sound pick-up apparatus PS would also probably collect sounds from a sound source around the area (non-target area sounds).

JP 2014-072708A proposes an area sound pick-up apparatus that collects target area sounds by directing directionalities from different directions to a target area, and causing the directionalities to intersect in the target area with a plurality of microphone arrays. The area sound pick-up apparatus described in JP 2014-072708A first estimates the power ratio of target area sounds included in the BF output of each microphone array, and then uses the power ratio as a correction coefficient. If the area sound pick-up apparatus described in JP 2014-072708A uses two microphone arrays as an example, the correction coefficient of the target area sound power is calculated on the basis of the following expressions (5) and (6), or (7) and (8).

$$\alpha_1(n) = \text{mode}\left(\frac{Y_{2k}(n)}{Y_{1k}(n)}\right) k = 1, 2, \ldots, N \tag{5}$$

$$\alpha_2(n) = \text{mode}\left(\frac{Y_{1k}(n)}{Y_{2k}(n)}\right) k = 1, 2, \ldots, N \tag{6}$$

$$\alpha_1(n) = \text{median}\left(\frac{Y_{2k}(n)}{Y_{1k}(n)}\right) k = 1, 2, \ldots, N \tag{7}$$

$$\alpha_2(n) = \text{median}\left(\frac{Y_{1k}(n)}{Y_{2k}(n)}\right) k = 1, 2, \ldots, N \tag{8}$$

In the expressions (5) to (8), $Y_{1\kappa}(n)$ and $Y_{2\kappa}(n)$ respectively represent the amplitude spectra of the BF outputs of the first and second microphone arrays. N represents the total number of frequency bins. K represents a frequency. $\alpha_1(n)$ and $\alpha_2(n)$ represent the power correction coefficients for the respective BF outputs. Further, in the expressions (5) to (8), mode represents a mode value, and median represents a median value.

Afterwards, the area sound pick-up apparatus described in JP 2014-072708A corrects each BF output and does SS by using the correction coefficient, thereby extracting non-target area sounds in the target area direction. The area sound pick-up apparatus described in JP 2014-072708A can extract target area sounds by further doing SS of the extracted non-target area sounds from each BF output. When extracting a non-target area sound $N_1(n)$ in the target area direction seen from a first microphone array, the area sound pick-up apparatus described in JP 2014-072708A does SS of a BF output $Y_2(n)$ of a second microphone array which has been multiplied by a power correction coefficient $\alpha_2$ from a BF output $Y_1(n)$ of the first microphone array as shown in the following expression (9). Further, the area sound pick-up apparatus described in JP 2014-072708A makes a calculation according to an expression (10) to extract a non-target area sound $N_2(n)$ in the target area direction seen from the second microphone array.

$$N_1(n)=Y_1(n)-\alpha_2(n)Y_2(n) \tag{9}$$

$$N_2(n)=Y_2(n)-\alpha_1(n)Y_1(n) \tag{10}$$

Afterwards, the area sound pick-up apparatus described in JP 2014-072708A does SS of the non-target area sounds from the respective BF outputs in accordance with expressions (11) and (12) to extract the target area sounds. In the expressions (11) and (12), $\gamma_1(n)$ and $\gamma_2(n)$ represent coefficients for changing the strength at the time of SS.

$$Z_1(n)=Y_1(n)-\gamma_1(n)N_1(n) \tag{11}$$

$$Z_2(n)=Y_2(n)-\gamma_2(n)N_2(n) \tag{12}$$

SUMMARY

However, if the sound volume level of background noise or non-target area sounds is high, the technique of JP 2014-072708A probably distorts target area sounds or produces harsh strange sounds referred to as musical noise due to SS done at the time of target area sound extraction. The technique of JP 2014-072708A has the possibility of making sounds difficult to hear and failing in smooth audio communication because of this influence.

The sound pick-up apparatus described in JP 2005-195955A depends on the accuracy of voice section detection. Accordingly, a high noise level lowers the voice section detection accuracy. It is thus difficult to stably suppress musical noise. Further, the sound pick-up apparatus described in JP 2005-195955A masks musical noise only in a non-voice section. Accordingly, when collecting only sounds from a sound source in a target area (specific area), the sound pick-up apparatus described in JP 2005-195955A cannot recognize non-target area sounds other than the target area as voices.

It is then desired to provide a sound pick-up apparatus and method that can improve, when performing area sound pick-up of collecting sounds from a sound source in a target area, the sound quality of the collected sounds (e.g. suppress the distortion of target area sounds or suppress musical noise).

A sound pick-up apparatus according to a first embodiment of the present invention includes: (1) a noise reduction unit configured to estimate background noise included in an input signal input from a microphone array, to acquire the estimated background noise as estimated noise, to use the acquired estimated noise to reduce a noise component of the input signal, and to acquire a noise-reduced signal; (2) a directionality formation unit configured to acquire, on the basis of the noise-reduced signal, a first non-target area sound having directionality formed in a direction other than a target area direction, and a target area direction sound having directionality formed in the target area direction; (3) a target area sound extraction unit configured to extract a second non-target area sound from the target area direction by using the target area direction sound, and to further use the second non-target area sound and the target area direction sound to acquire a target area sound from a sound source in the target area; (4) a mixing level calculation unit configured to calculate a sound volume level of a mixing signal to mix with the target area sound on the basis of power of the estimated noise, power of the first non-target area sound, and power of the second non-target area sound; (5) a mixing level adjustment unit configured to adjust a sound volume level of the input signal to mix with the mixing signal, and a sound volume level of the estimated noise to mix with the mixing signal on the basis of the sound volume level of the mixing signal which is calculated by the mixing level calculation unit; and (6) a signal mixing unit configured to generate and output a mixed target area sound in which the input signal that is adjusted to have the sound volume level calculated by the mixing level adjustment unit and the estimated noise that is adjusted to have the sound volume level calculated by the mixing level adjustment unit are mixed with the target area sound.

A sound pick-up program according to a second embodiment of the present invention causes a computer to function as: (1) a noise reduction unit configured to estimate background noise included in an input signal input from a microphone array, to acquire the estimated background noise as estimated noise, to use the acquired estimated noise to reduce a noise component of the input signal, and to acquire a noise-reduced signal; (2) a directionality formation unit configured to acquire, on the basis of the noise-reduced signal, a first non-target area sound having directionality formed in a direction other than a target area direction, and a target area direction sound having directionality formed in the target area direction; (3) a target area sound extraction unit configured to extract a second non-target area sound from the target area direction by using the target area direction sound, and to further use the second non-target area sound and the target area direction sound to acquire a target area sound from a sound source in the target area; (4) a mixing level calculation unit configured to calculate a sound volume level of a mixing signal to mix with the target area sound on the basis of power of the estimated noise, power of the first non-target area sound, and power of the second non-target area sound; (5) a mixing level adjustment unit configured to adjust a sound volume level of the input signal to mix with the mixing signal, and a sound volume level of the estimated noise to mix with the mixing signal on the basis of the sound volume level of the mixing signal which is calculated by the mixing level calculation unit; and (6) a signal mixing unit configured to generate and output a mixed target area sound in which the input signal that is adjusted to have the sound volume level calculated by the mixing level adjustment unit and the estimated noise that is adjusted to have the sound volume level calculated by the mixing level adjustment unit are mixed with the target area sound.

A sound pick-up method according to a third embodiment of the present invention includes: (1) estimating, by a noise reduction unit, background noise included in an input signal input from a microphone array, acquiring the estimated background noise as estimated noise, using the acquired estimated noise to reduce a noise component of the input signal, and acquiring a noise-reduced signal; (2) acquiring, by a directionality formation unit, on the basis of the noise-reduced signal, a first non-target area sound having directionality formed in a direction other than a target area direction, and a target area direction sound having directionality formed in the target area direction; (3) extracting, by a target area sound extraction unit, a second non-target area sound from the target area direction by using the target area direction sound, and further using the second non-target area sound and the target area direction sound to acquire a target area sound from a sound source in the target area; (4) calculating, by a mixing level calculation unit, a sound volume level of a mixing signal to mix with the target area sound on the basis of power of the estimated noise, power of the first non-target area sound, and power of the second non-target area sound; (5) adjusting, by a mixing level adjustment unit, a sound volume level of the input signal to mix with the mixing signal, and a sound volume level of the estimated noise to mix with the mixing signal on the basis of the sound volume level of the mixing signal which is calculated by the mixing level calculation unit; and (6) generating and outputting, by a signal mixing unit, a mixed target area sound in which the input signal that is adjusted to have the sound volume level calculated by the mixing level adjustment unit and the estimated noise that is adjusted to have the sound volume level calculated by the mixing level adjustment unit are mixed with the target area sound.

According to an embodiment of the present invention, it is possible to improve, when area sound pick-up is performed to collect sounds from a sound source in a target area, the sound quality of the collected sounds.

DETAILED DESCRIPTION OF THE EMBODIMENT(S)

Figure 1:
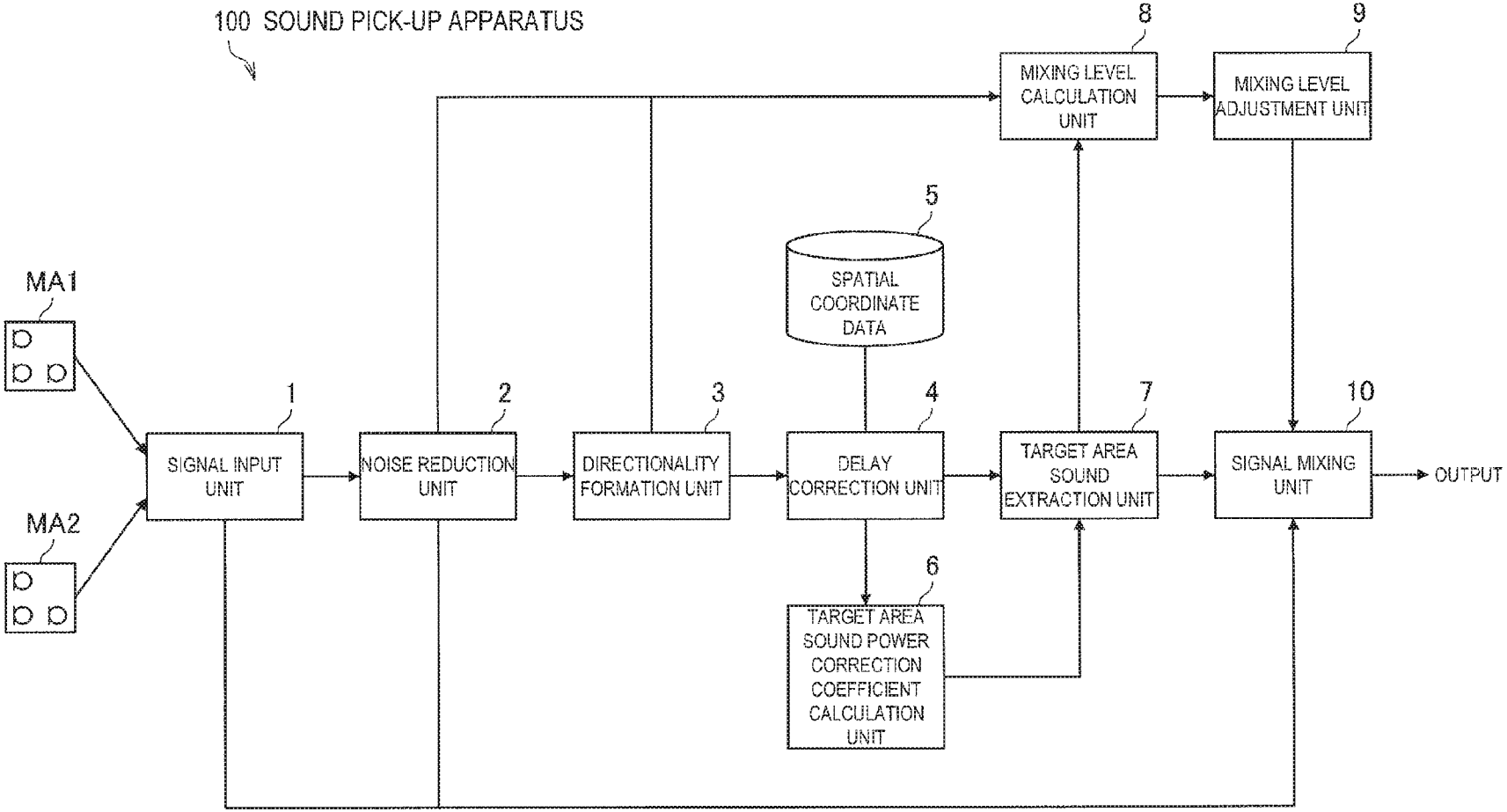
FIG. 1 is a block diagram illustrating a functional configuration of a sound pick-up apparatus according to an embodiment.

Hereinafter, referring to the appended drawings, preferred embodiments of the present invention will be described in detail. It should be noted that, in this specification and the appended drawings, structural elements that have substantially the same function and structure are denoted with the same reference numerals, and repeated explanation thereof is omitted.

(A) Primary Embodiment

The following describes a sound pick-up apparatus and a method according to an embodiment of the present invention in detail with reference to the drawings.

(A-1) Configuration According to Embodiment

FIG. 1 is a block diagram illustrating the functional configuration of a sound pick-up apparatus 100 according to the present embodiment.

The sound pick-up apparatus 100 uses two microphone arrays MA (MA1 and MA2) to perform target area sound pick-up processing of collecting target area sounds from a sound source in a target area.

Figure 3:
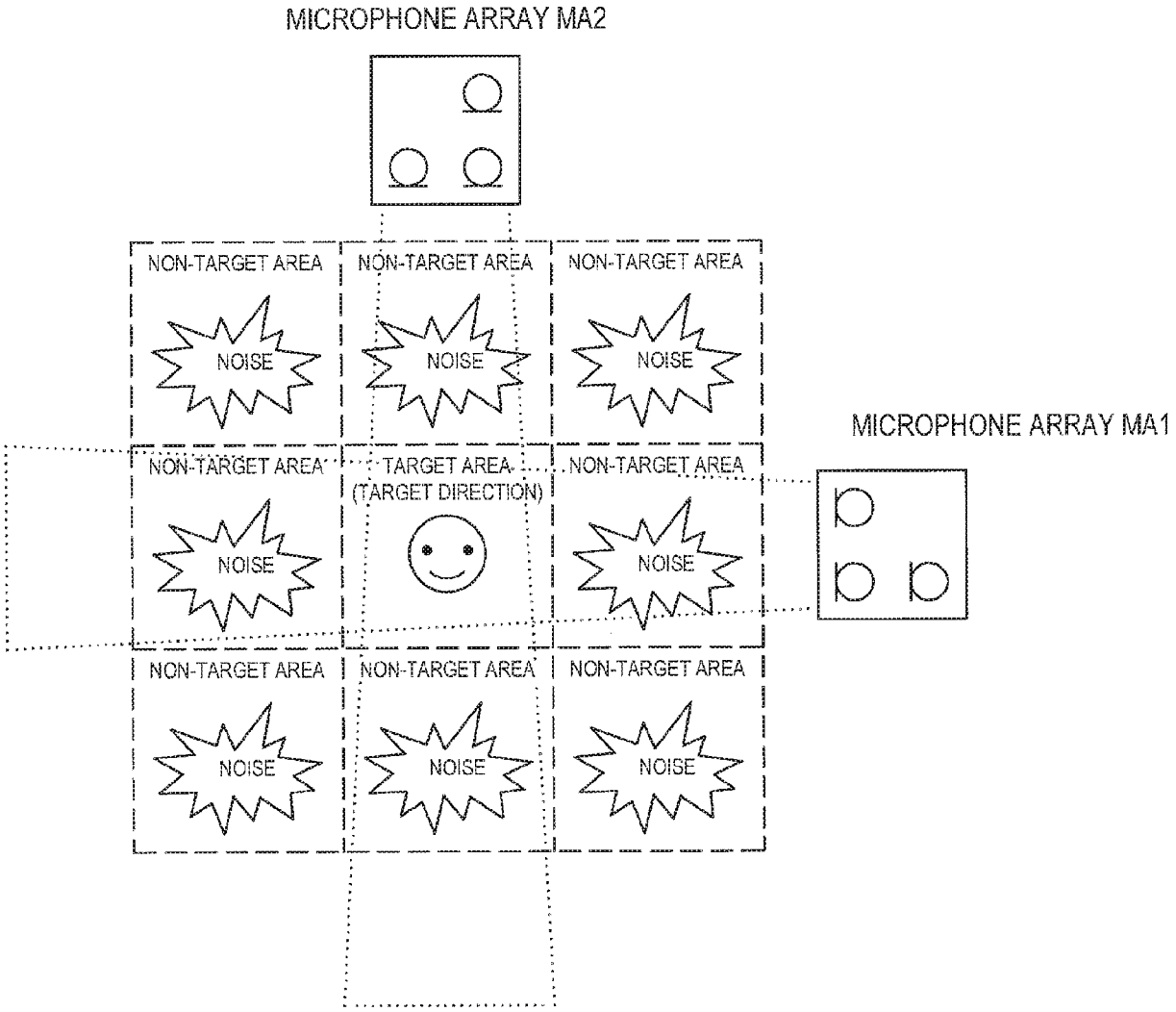
FIG. 3 is an explanatory diagram illustrating a configuration example in which directionalities of beam formers (BFs) of two microphone arrays according to an embodiment are directed to a target area from different directions.

The microphone arrays MA1 and MA2 are disposed in given places in the space in which the target area is present. The microphone arrays MA1 and MA2 can be disposed at any positions with respect to the target area as long as the directionalities overlap with each other only in the target area as illustrated, for example, in FIG. 3. For example, the microphone arrays MA1 and MA2 may be disposed to face each other across the target area. Each of the microphone arrays MA includes two or more microphones M, and collects acoustic signals through each of the microphones M. The present embodiment will be described with three microphones M1, M2, and M3 disposed in each of the microphone arrays MA. In other words, each of the microphone arrays MA composes a 3-ch microphone array. Note that the number of microphone arrays MA is not limited to two. If there are a plurality of target areas, it is necessary to dispose microphone arrays MA enough to cover all of the areas.

Figure 2:
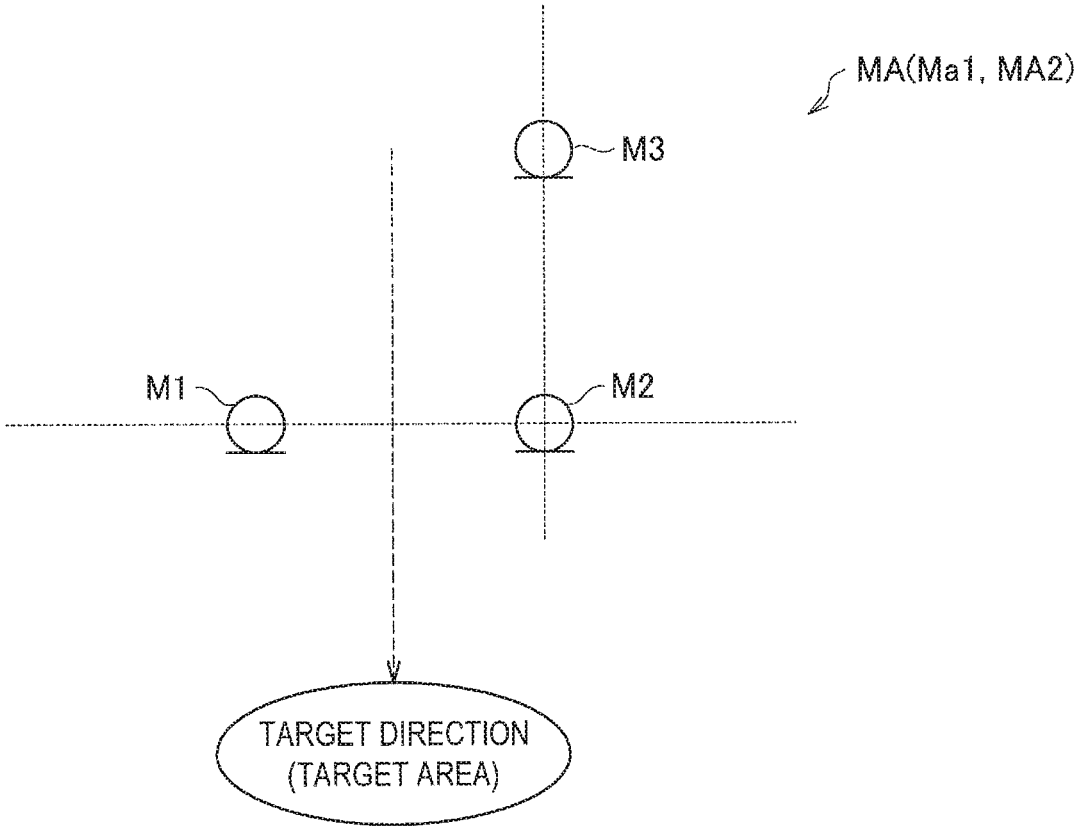
FIG. 2 is an explanatory diagram illustrating an example of a positional relationship between microphones according to an embodiment.

FIG. 2 is an explanatory diagram illustrating the positional relationship between the microphones M1, M2, and M3 in each of the microphone arrays MA.

As illustrated in FIG. 2, each of the microphone arrays MA has the two microphones M1 and M2 disposed parallel to the direction of a target area, and has the microphone M3 disposed on the straight line that is orthogonal to the straight line connecting the microphone M1 to the microphone M2 and connects to any one of the microphones M1 and M2. The distance between the microphones M3 and M2 is then set as the same as the distance between the microphones M1 and M2. In other words, it is assumed that the three microphones M1, M2 and M3 are disposed at the apexes of an isosceles right triangle.

The sound pick-up apparatus 100 includes a signal input unit 1, a noise reduction unit 2, a directionality formation unit 3, a delay correction unit 4, spatial coordinate data 5, a target area sound power correction coefficient calculation unit 6, a target area sound extraction unit 7, a mixing level calculation unit 8, a mixing level adjustment unit 9, and a signal mixing unit 10. The detailed processing of each functional block included in the sound pick-up apparatus 100 will be described below.

The sound pick-up apparatus 100 may be entirely configured with hardware (such as an exclusive chip), or may be configured with software (program) for a part or all. The sound pick-up apparatus 100 may be configured, for example, by installing a program (including a sound pick-up program according to an embodiment) in a computer including a processor and a memory.

The sound pick-up apparatus 100 according to the present embodiment adjusts the sound volume levels of input signals and estimated noise from any one of the microphone arrays MA in accordance with the volumes of background noise and non-target area sounds, and mixes extracted target area sounds therewith.

The processing of extracting target area sounds produces a stronger musical noise as the sound volume levels of background noise and non-target area sounds grow higher. Accordingly, the sound pick-up apparatus 100 also raises the total sound volume level of input signals and estimated noise to mix in proportion to the sound volume levels of background noise and non-target area sounds. The sound pick-up apparatus 100 calculates the sound volume level of background noise to mix, on the basis of estimated noise obtained in the process of reducing the background noise. Meanwhile, the sound pick-up apparatus 100 calculates the sound volume level of non-target area sounds to mix, on the basis of a combination of non-target area sounds in the target area direction which are extracted in the process of emphasizing target area sounds with non-target area sounds in a direction other than the target area direction.

The sound pick-up apparatus 100 decides the ratio of input signals to estimated noise to mix, on the basis of the sound volume levels of the estimated noise and non-target area sounds. If the sound volume level of input signals to mix is too high with non-target area sounds close to the target area, the non-target area sounds blend with the target area sounds. As a result, it is no longer possible to tell which is the target area sounds. The sound pick-up apparatus 100 then lowers the sound volume level of input signals to mix and raises the sound volume level of estimated noise to mix, and mixes the input signals and the estimated noise in the case of loud non-target area sounds. In other words, if there is no non-target area sound or the sound volume level of non-target area sounds is low, the sound pick-up apparatus 100 mixes input signals and estimated noise at an increased ratio of the input signals. Conversely, if the sound volume level of non-target area sounds is high, the sound pick-up apparatus 100 mixes input signals and estimated noise at an increased ratio of the estimated noise.

(A-2) Operation According to Embodiment

Next, the operation of the sound pick-up apparatus 100 according to the present embodiment configured as described above will be described.

The signal input unit 1 converts acoustic signals collected through the microphone arrays MA1 and MA2 from analog signals to digital signals, and inputs the converted digital signals. Afterwards, the signal input unit 1 converts the digital signals from the time domain to the frequency domain by using, for example, fast Fourier transform.

The noise reduction unit 2 estimates and reduces the components of the background noise included in the signals acquired by the signal input unit 1. For example, SS and Wiener filtering can be used for the noise reduction processing performed by the noise reduction unit 2.

The directionality formation unit 3 extracts non-target area sounds in a direction other than the target direction through each of the microphone arrays MA (e.g. extracts non-target area sounds by using a bidirectional filter), and subtracts the amplitude spectrum of the extracted non-target area sounds from the amplitude spectrum of the input signals, thereby acquiring sounds (BF output) having directionality formed in the target area. Specifically, the directionality formation unit 3 acquires, as a BF output, sounds having directionality formed in the target area direction by a BF in accordance with the expression (4) on the basis of the signals whose background noise has been reduced by the noise reduction unit 2 for each of the microphone arrays MA. In the present embodiment, the directionality formation unit 3 thus acquires a BF output having directionality formed in the target area direction for each of the microphone arrays MA, and retains even the non-target area sounds that have been acquired in the process of acquiring the BF output and have directionality formed in a direction other than the target area direction. Additionally, no limitations are imposed on the specific calculation method for the directionality formation unit 3 to acquire a BF output and non-target area sounds having directionality formed in a direction other than the target area direction.

The delay correction unit 4 calculates and corrects the delay caused by the difference in the distances between the target area and the respective microphone arrays. First of all, the delay correction unit 4 acquires the positions of the target area and each of the microphone arrays MA from the spatial coordinate data 5, and then calculates the difference in arrival time between the target area sounds arriving at the respective microphone arrays MA. Next, the delay correction unit 4 adds delay on the basis of the microphone array MA disposed at the farthest position from the target area in a manner that the target area sounds concurrently arrive at all the microphone arrays MA.

The spatial coordinate data 5 contain positional information on all the target areas and positional information on each of the microphone arrays MA.

The target area sound power correction coefficient calculation unit 6 calculates, in accordance with the expressions (5) and (6), or (7) and (8), the correction coefficients for equalizing the power of the target area sound components included in the respective BF outputs.

The target area sound extraction unit 7 does SS from the BF output data corrected with the correction coefficient calculated by the target area sound power correction coefficient calculation unit 6 in accordance with the expression (9) or (10) to extract the non-target area sounds in the target area direction. The target area sound extraction unit 7 further does SS of the extracted non-target area sounds from each BF output in accordance with the expression (11) or (12) to extract the target area sounds.

The mixing level calculation unit 8 calculates the power of estimated noise estimated by the noise reduction unit 2, non-target area sounds in a direction other than the target area direction which are extracted by the directionality formation unit 3, and non-target area sounds in the target area direction which are extracted by the target area sound extraction unit 7, and decides the total sound volume level (sound volume level of the mixing signals) of input signals and background noise to mix with the target area sounds on the basis of the magnitude of the total value. If the sound pick-up apparatus 100 performs area sound pick-up chiefly with the microphone array MA1, and estimated noise $B_1(n)$, a non-target area sound $M_1(n)$ in a direction other than the target area direction, and a non-target area sound $N_1(n)$ in the target area direction total up to $A_1(n)$, where the estimated noise $B_1(n)$ is estimated from the input signals of the microphone array MA1 on the basis of the expression (11), the non-target area sound $M_1(n)$ is extracted in accordance with the expression (3), the non-target area sound $N_1(n)$ is extracted in accordance with the expression (9), the mixing level is assumed to be $\delta_1 A_1(n)$. Here, $\delta_1$ represents a variable proportionate to the SN ratio of the target area sound $Z_1(n)$ to $A_1(n)$. For example, $\delta_1$ has a value that makes $A_1(n)$ be −20 dB at an SN ratio of 0 dB.

The mixing level adjustment unit 9 adjusts the sound volume levels of the input signals and the estimated noise to mix with the target area sounds on the basis of the mixing level calculated by the mixing level calculation unit 8 and the power ratio of the estimated noise to the non-target area sounds.

It is assumed here that the target area sound extraction unit 7 performs area sound pick-up chiefly with the microphone array MA1 in accordance with the expression (11). In this case, the mixing level adjustment unit 9 sets a value inversely proportionate to the power ratio $(M_1(n)+N_1(n))/B_1(n)$ of the estimated noise $B_1(n)$ to the non-target area sounds $(M_1(n)+N_1(n))$ as a variable $\lambda_1$ for deciding the ratio of input signals to estimated noise to mix. For example, if $(M_1(n)+N_1(n))/B_1(n)=0$, the mixing level adjustment unit 9 sets $\lambda_1=1$. $\lambda_1$ is assumed to have a value from 0 to 1. Furthermore, a variable $\mu_1$ for satisfying the mixing level $\delta_1 A_1(n)$ is calculated on the basis of an expression (13). Since the microphone array MA1 is chiefly used for area sound pick-up, an input signal $X_{11}(n)$ acquired from any of the microphones composing the microphone array MA1 is applied to the expression (13).

$$\mu_1 = \frac{\delta_1 A_1(n)}{\lambda_1 X_{11}(n) + (1-\lambda_1)B_1(n)} \tag{13}$$

The signal mixing unit 10 mixes the input signals acquired by the signal input unit 1 and the noise estimated by the noise reduction unit 2 with the target area sounds extracted by the target area sound extraction unit 7 on the basis of the ratio calculated by the mixing level adjustment unit 9. As discussed above, the target area sound extraction unit 7 performs area sound pick-up chiefly with the microphone array MA1 in accordance with the expression (11). The signal mixing unit 10 thus mixes the signals by using an expression (14) to acquire a final output $W_1(n)$.

$$W_1(n)=Z_1(n)+\mu_1\{\lambda_1 X_{11}(n)+(1-\lambda_1)B_1(n)\} \tag{14}$$

(A-3) Advantageous Effects According to Embodiment

According to the present embodiment, the following advantageous effects can be attained.

Figure 4A:
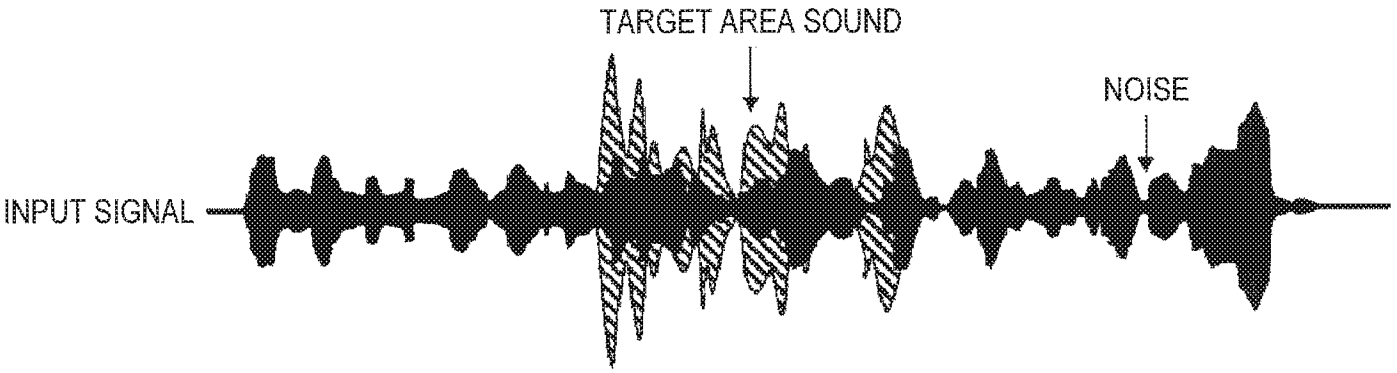
FIG. 4A is a diagram illustrating a waveform of an input signal in a sound pick-up apparatus according to an embodiment.
Figure 4B:
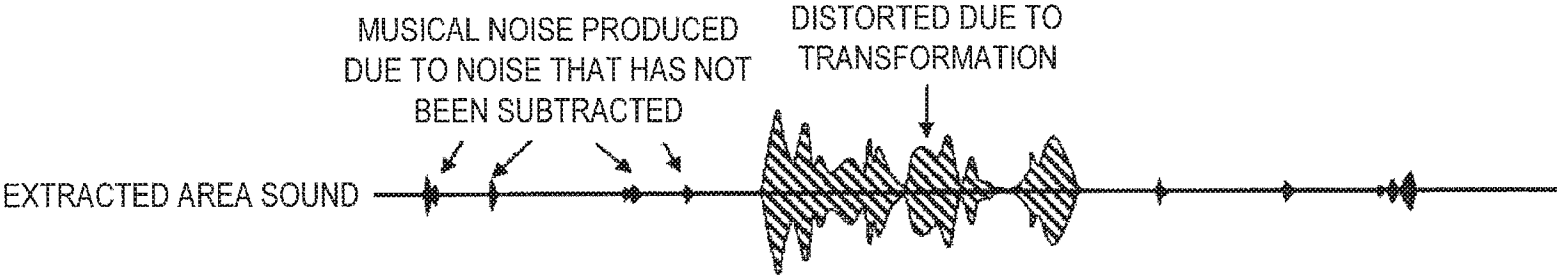
FIG. 4B is an explanatory diagram illustrating a waveform of a target area sound with which a sound pick-up apparatus according to an embodiment has not yet mixed an input signal and estimated noise.
Figure 4C:
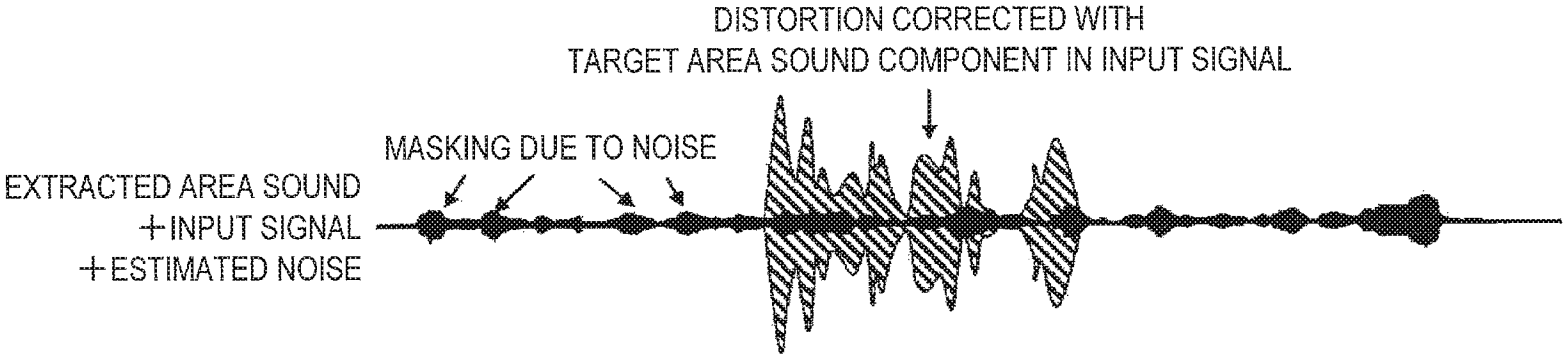
FIG. 4C is an explanatory diagram illustrating a waveform of a target area sound with which a sound pick-up apparatus according to an embodiment has mixed an input signal and estimated noise.

As illustrated in FIGS. 4A to 4C, the sound pick-up apparatus 100 according to the present embodiment mixes input signals and estimated noise from microphones with the target area sounds in accordance with noise environments around the target area.

Each of FIGS. 4A to 4C is an explanatory diagram illustrating the processing for the sound pick-up apparatus 100 to adjust input signal and estimated noise, and to mix the input signal and the estimated noise with the target area sound.

FIG. 4A is a diagram illustrating the waveform of input signals (waveform including target area sounds and noise). FIG. 4B is an explanatory diagram illustrating the waveform of target area sounds (waveform having musical noise and distortion) that have not yet been mixed with input signals and estimated noise. FIG. 4C is an explanatory diagram illustrating the waveform of target area sounds that have been mixed with input signals and estimated noise.

As illustrated in FIG. 4C, the sound pick-up apparatus 100 masks musical noise in target area sounds to output, thereby allowing the musical noise to sound natural like normal background noise. Since input signals from the microphone array MA1 originally include the components of target area sounds, the sound pick-up apparatus 100 mixes the input signals with the target area sounds as illustrated in FIG. 4C, thereby attaining the advantageous effects of correcting the distortion of the target area sounds and improving the sound quality. Furthermore, the sound pick-up apparatus 100 adjusts the sound volume levels of input signals and estimated noise to mix in accordance with the sound volume level of non-target area sounds, and can thus reduce the non-target area sounds that blend with the target area sounds.

Next, the following experiment (which will be referred to as "present experiment") was conducted to examine the above-described advantageous effects of the sound pick-up apparatus 100. In the present experiment, one speaker was installed inside a target area and the other speaker was installed outside in the office environment, and the respective speakers reproduced the voices serving as the target area sounds and the non-target area sounds.

In the present experiment, 20 subjects are asked in this situation to listen to and compare the sounds obtained by outputting, from the speakers, acoustic signals (acoustic signals in which input signals and estimated noise were mixed with extracted area sounds) output from the signal mixing unit 10 of the sound pick-up apparatus 100 according to an embodiment of the present invention and the sounds obtained by outputting, from the speakers, acoustic signals (acoustic signals of extracted area sounds that had not yet been mixed with input signals and estimated noise) output from the target area sound extraction unit 7, and then to make subjective evaluations (questionnaire survey made by asking the 20 subjects). The evaluation items of the present experiment included "emphasis feeling" (whether or not the target area sounds were emphasized) and "audibility" (whether or not the target area sounds were easy to listen to).

Figure 5A:
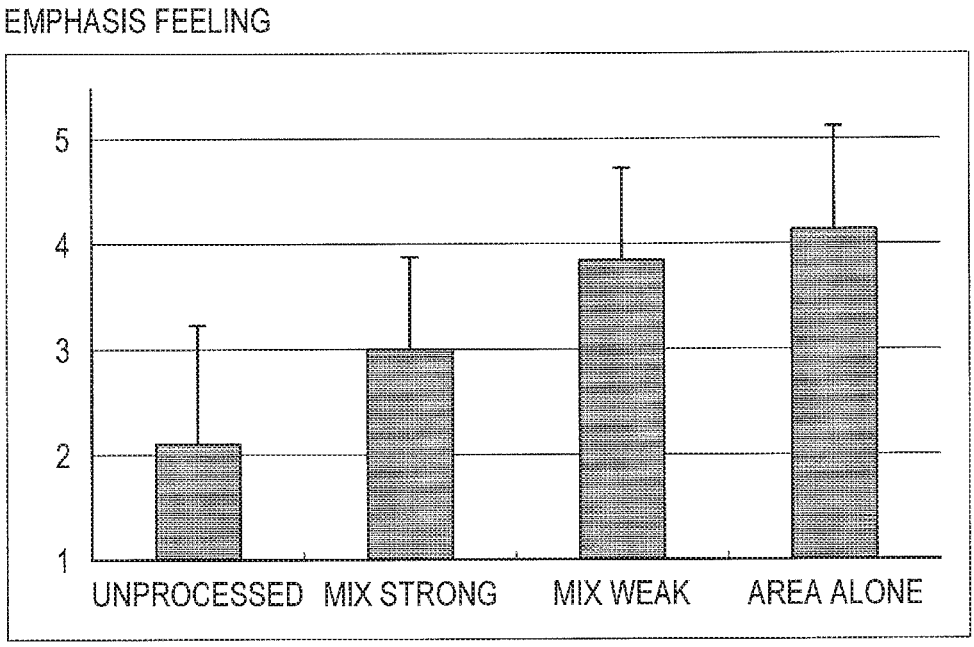
FIG. 5A is an explanatory diagram illustrating an experimental result for proving an advantageous effect of a sound pick-up apparatus according to an embodiment.
Figure 5B:
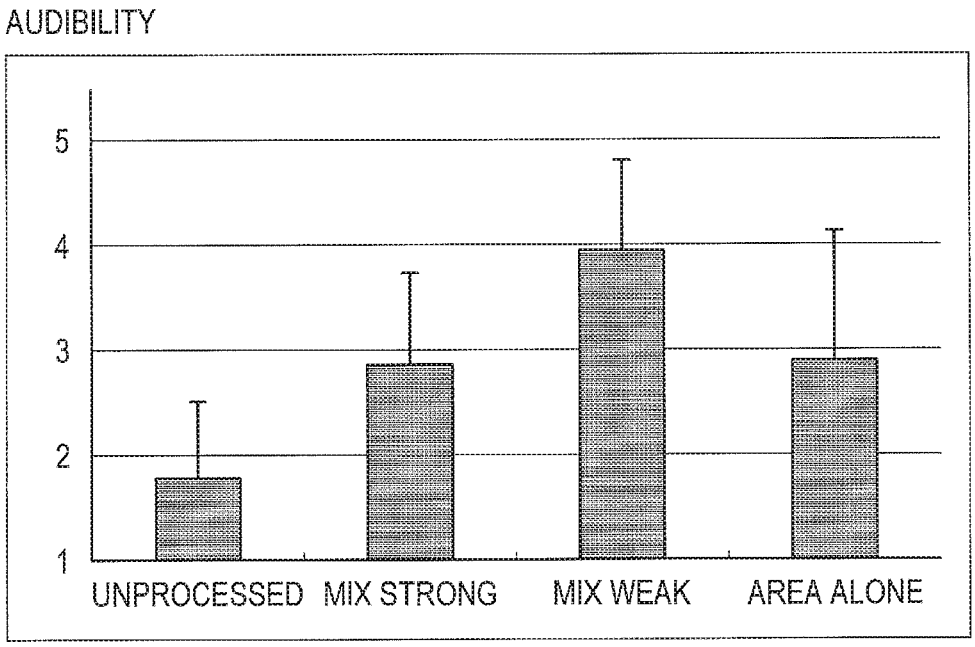
FIG. 5B is an explanatory diagram illustrating an experimental result for proving an advantageous effect of a sound pick-up apparatus according to an embodiment.
Figure 6:
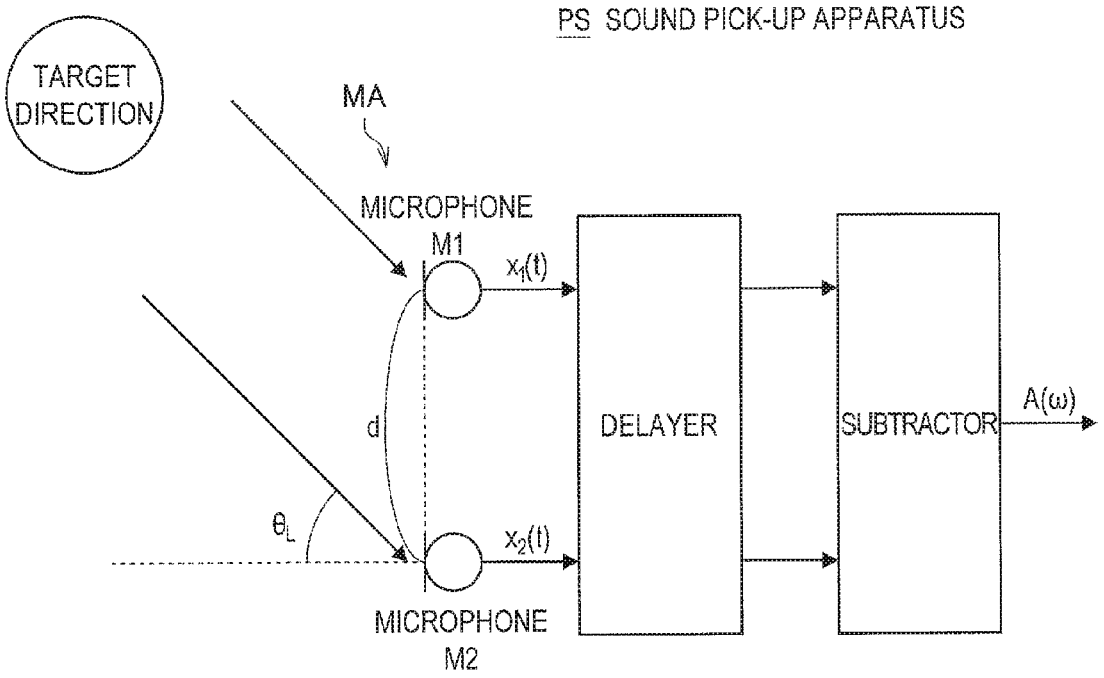
FIG. 6 is a block diagram illustrating a configuration of a conventional sound pick-up apparatus.
Figure 7A:
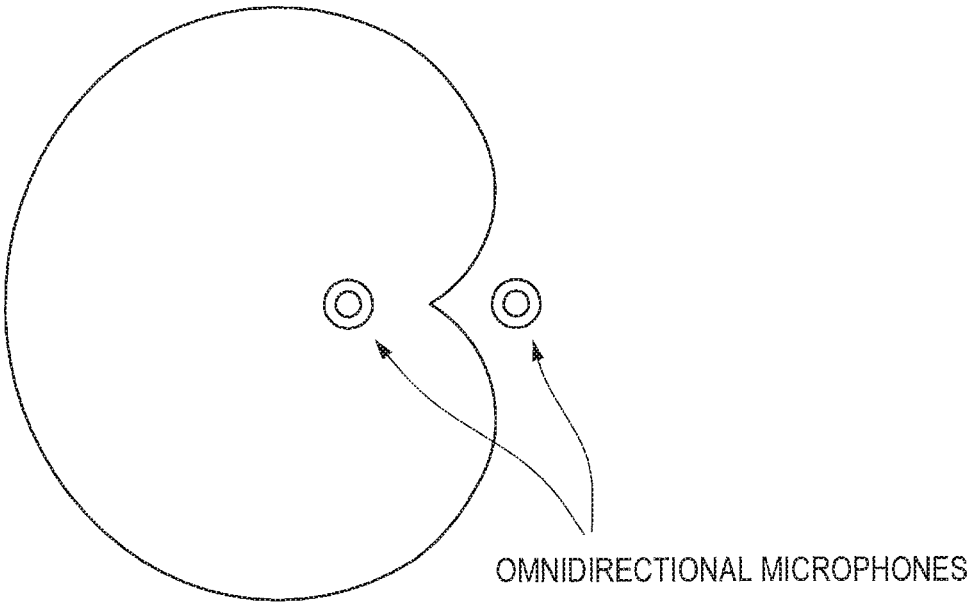
FIG. 7A is an explanatory diagram for describing an example of a characteristic of directionality formed by a conventional directional filter.
Figure 7B:
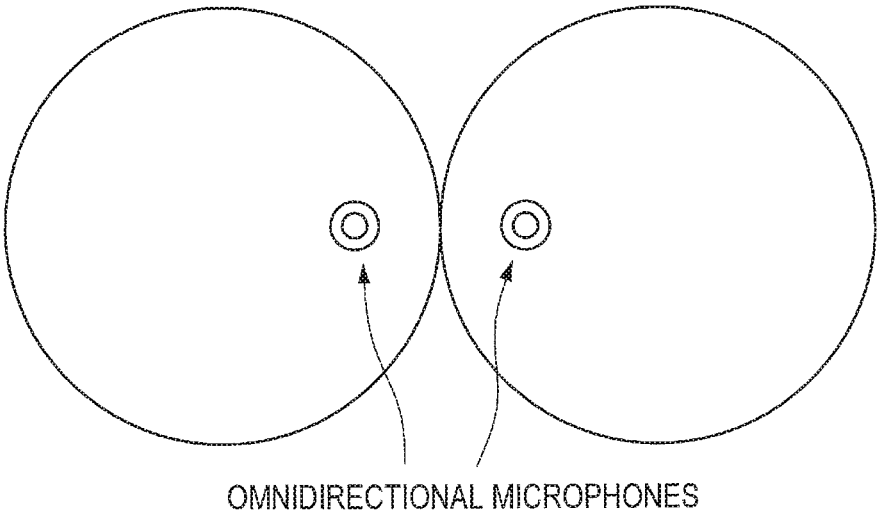
FIG. 7B is an explanatory diagram for describing an example of a characteristic of directionality formed by a conventional directional filter.

Each of FIGS. 5A and 5B is an explanatory diagram illustrating results of the subjective evaluations of the present experiment.

As illustrated in FIGS. 5A and 5B, the subjects were asked in the present experiment to listen to sounds and to make subjective evaluations about "emphasis feeling" and "audibility" of the target sounds under the four conditions including "unprocessed," "MIX strong," "MIX weak," and "area alone." FIG. 5A illustrates results of the subjective evaluations about the emphasis feeling (emphasis feeling of the target sounds) made by the subjects who had listened to the sounds (target sounds) under the four conditions discussed above. FIG. 5B illustrates results of the subjective evaluations about the audibility (audibility of the target sounds) made by the subjects who had listened to the target sounds under the four conditions discussed above. The subjects were each asked in the present experiment to make a subjective evaluation in accordance with a method complying with the audio mean opinion score (MOS) test after listening to the sounds under each condition. The subjects were each asked in the present experiment to listen to voices using the voices of human beings as the target sounds under each condition, and to rate the quality (the emphasis feeling of the voices and the audibility of the voices) on a scale of 1 to 5 (1 represents the worst sound quality and 5 represents the best sound quality). Each of FIGS. 5A and 5B illustrates the mean values (mean values of the 20 subjects) of the evaluation results.

The subjects were asked in the present experiment to listen to the sounds obtained by outputting, from the speakers, input signals as input to the sound pick-up apparatus 100 under the condition of "unprocessed." The subjects were asked in the present experiment to listen to the sound obtained by outputting, from the speakers, acoustic signals that were output from the signal mixing unit 10, and had a higher sound volume level (higher than that of the condition of MIX weak discussed below) at the time of mixing input signals and estimated noise with the extracted area sounds under the condition of "MIX strong." The subjects were asked in the present experiment to listen to the sounds obtained by outputting, from the speakers, acoustic signals that had a lower sound volume level (lower than that of the condition of MIX strong) at the time of mixing input signals and estimated noise with the extracted area sounds under the condition of "MIX weak." The subjects were asked in the present experiment to listen to the sounds obtained by outputting, from the speakers, acoustic signals (acoustic signals of the extracted area sounds that had not yet been mixed with input signals and estimated noise) output from the target area sound extraction unit 7 under the condition of "area alone."

In other words, the two conditions of MIX weak and MIX strong are used for the sound pick-up apparatus 100 according to an embodiment of the present invention to collect and output acoustic signals (signals output from the signal mixing unit 10).

FIG. 5A shows that the condition of MIX weak offers the emphasis feeling equivalent to that of area alone. FIG. 5B further shows that the condition of MIX weak offers more audible target sounds than the condition of area alone does. This is probably because musical noise is masked by mixing input signals and estimated noise under the condition of MIX weak, and the distortion of the target area sounds is corrected. The above-described results show that acoustic signals output from the sound pick-up apparatus 100 can maintain the emphasis feeling equivalent to that of extracted area sounds (such as sounds under "area alone" in the present experiment) provided by the conventional technology and improve the audibility.

(B) Other Embodiments

The present invention is not limited to the above-described embodiment, but can be applied to the following modification.

(B-1) Although the sound pick-up apparatus 100 processes signals collected by the two microphones M1 and M2 in the above-described embodiment, the sound pick-up apparatus 100 may process signals collected by three or more microphones.

(B-2) Although the above-described embodiment shows that acoustic signals obtained by being caught by microphones are processed in real time, the acoustic signals obtained by being caught by microphones may be stored in a storage medium, and afterwards, target sounds, and emphasized signals of target area sounds may be obtained by performing reading and processing from the storage medium. In this way, if a storage medium is used, the places in which the microphones are set may be separate from the place in which extraction processing is performed on target sounds and target area sounds. Similarly, even if processing is performed in real time, the places in which the microphones are set may be separate from the place in which extraction processing is performed on target sounds and target area sounds, and signals may be supplied to a remote place through communication.

Heretofore, preferred embodiments of the present invention have been described in detail with reference to the appended drawings, but the present invention is not limited thereto. It should be understood by those skilled in the art that various changes and alterations may be made without departing from the spirit and scope of the appended claims.

What is claimed is:

1. A sound pick-up apparatus comprising:

a processor configured to receive an input signal, and to process the input signal according to a plurality of functional units of the processor to mix an extracted target area sound; and memory, configured to provide to the processor instructions for the processor to perform the operations of the plurality of functional units, wherein the plurality of functional units of the processor include:

a noise reduction unit configured to estimate background noise included in the input signal input from a microphone array, to acquire the estimated background noise as estimated noise, to use the acquired estimated noise to reduce a noise component of the input signal, and to acquire a noise-reduced signal;

a directionality formation unit configured to acquire, on the basis of the noise-reduced signal, a first non-target area sound having directionality formed in a direction other than a target area direction, and a target area direction sound having directionality formed in the target area direction;

a target area sound extraction unit configured to extract a second non-target area sound from the target area direction by using the target area direction sound, and to further use the second non-target area sound and the target area direction sound to acquire the target area sound from a sound source in the target area;

a mixing level calculation unit configured to calculate a sound volume level of a mixing signal to mix with the target area sound on the basis of power of the estimated noise, power of the first non-target area sound, and power of the second non-target area sound;

a mixing level adjustment unit configured to adjust a sound volume level of the input signal to mix with the mixing signal, and a sound volume level of the estimated noise to mix with the mixing signal on the basis of the sound volume level of the mixing signal which is calculated by the mixing level calculation unit; and a signal mixing unit configured to generate and output a mixed target area sound in which the input signal that is adjusted to have the sound volume level calculated by the mixing level adjustment unit and the estimated noise that is adjusted to have the sound volume level calculated by the mixing level adjustment unit are mixed with the target area sound.

2. The sound pick-up apparatus according to claim 1, wherein the mixing level adjustment unit calculates a sound volume level of the mixing signal to mix with the target area sound on the basis of a total value of the power of the estimated noise, the power of the first non-target area sound, and the power of the second non-target area sound.

3. The sound pick-up apparatus according to claim 2, wherein the mixing level adjustment unit calculates a ratio of the input signal to mix with the target area sound in the mixing signal to the estimated noise on the basis of a ratio of a total of the power of the first non-target area sound and the power of the second non-target area sound to the power of the estimated noise, and adjusts the sound volume level of the input signal to mix with the mixing signal and the sound volume level of the estimated noise to mix with the mixing signal in accordance with the calculated ratio.

4. A sound pick-up method comprising:

estimating by a processor a background noise included in an input signal input from a microphone array;

acquiring the estimated background noise as estimated noise;

using the acquired estimated noise to reduce a noise component of the input signal;

acquiring a noise-reduced signal;

acquiring, on the basis of the noise-reduced signal, a first non-target area sound having directionality formed in a direction other than a target area direction, and a target area direction sound having directionality formed in the target area direction;

extracting a second non-target area sound from the target area direction by using the target area direction sound, and further using the second non-target area sound and the target area direction sound to acquire a target area sound from a sound source in the target area;

calculating by the processor a first sound volume level of a mixing signal to mix with the target area sound on the basis of power of the estimated noise, power of the first non-target area sound, and power of the second non-target area sound;

adjusting by the processor a second sound volume level of the input signal to mix with the mixing signal, and a third sound volume level of the estimated noise to mix with the mixing signal on the basis of the first sound volume level of the mixing signal; and generating and outputting a mixed target area sound in which the input signal that is adjusted to have the first sound volume level and the estimated noise that is adjusted to have the third sound volume level are mixed with the target area sound.

* * * * *